United States Patent [19]

Box

[11] 4,083,427

[45] Apr. 11, 1978

[54] LADDER SCAFFOLD

[76] Inventor: Eli Box, 1737 Lexington NW., Warren, Ohio 44495

[21] Appl. No.: 745,427

[22] Filed: Nov. 26, 1976

[51] Int. Cl.[2] ..... E04G 1/08; E04G 1/30

[52] U.S. Cl. ..... 182/118; 182/229

[58] Field of Search ..... 182/119, 118, 178, 179, 182/214, 27, 82, 229

[56] References Cited

U.S. PATENT DOCUMENTS

| | | | |
|---|---|---|---|
| 460,419 | 9/1891 | Albee | 182/210 |
| 991,182 | 5/1911 | Thaubald | 182/118 |
| 1,890,029 | 12/1932 | Delfs | 182/119 |
| 3,007,540 | 11/1961 | Reinhardt | 182/118 |
| 3,071,206 | 1/1963 | Kristen | 182/119 |
| 3,474,881 | 10/1969 | Green | 182/27 |
| 3,903,991 | 9/1975 | Phelan | 182/229 |

FOREIGN PATENT DOCUMENTS

| | | | |
|---|---|---|---|
| 163,289 | 6/1949 | Austria | 182/118 |

*Primary Examiner*—Reinaldo P. Machado
*Attorney, Agent, or Firm*—Jacob Trachtman

[57] ABSTRACT

A pair of extension ladders are arranged in spaced, paralled vertically upright position. Diagonally extending cross braces extend between and are secured to the ladders to hold the ladders in upright position. A pair of wheels are provided on the bottom of one of the ladders to allow the scaffold to be easily moved by lifting up the other ladder. Hooks are provided on the ladders which fit into eyebolts on a building to hold the scaffold in position next to the building.

5 Claims, 3 Drawing Figures

FIG. 1
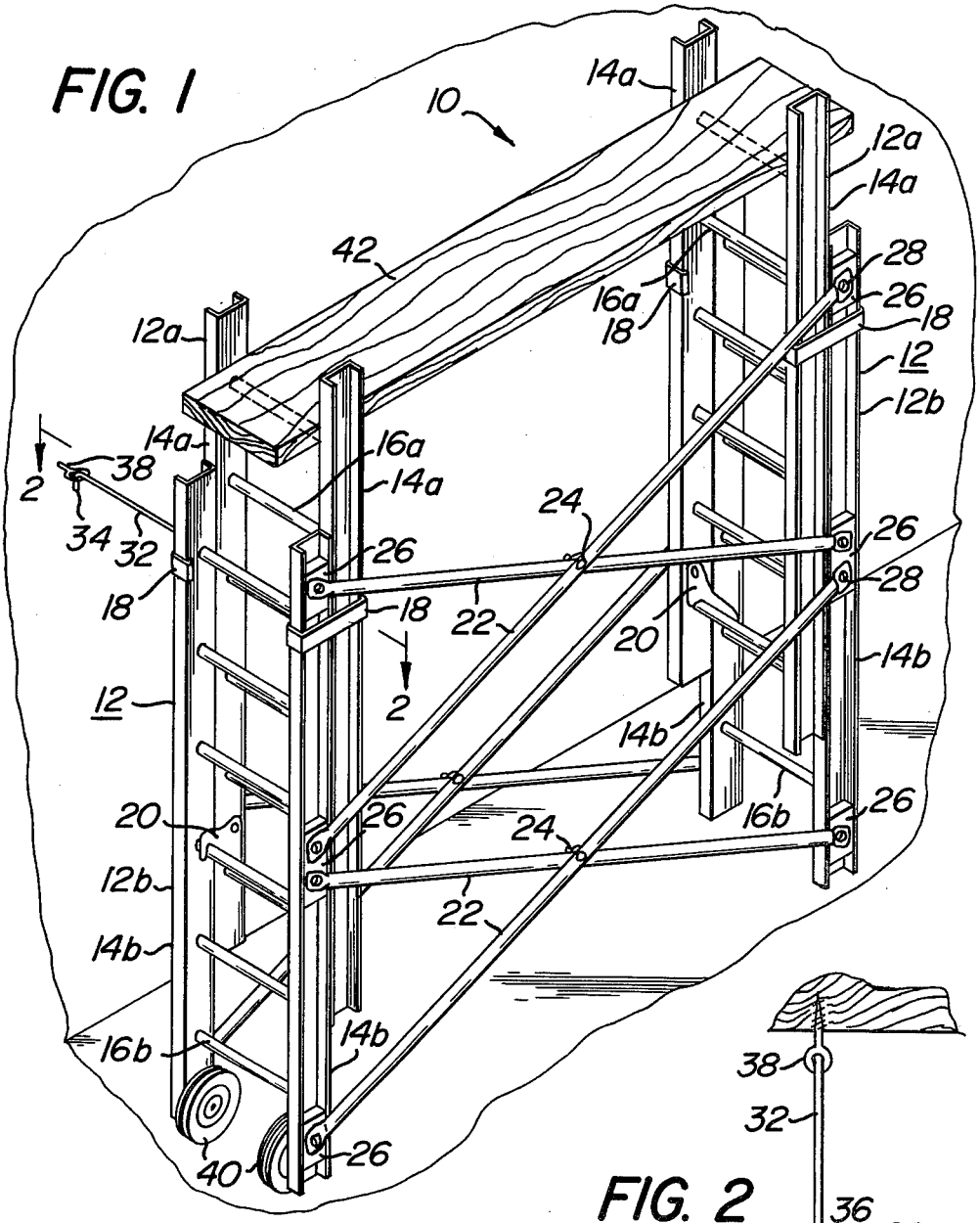
FIG. 2
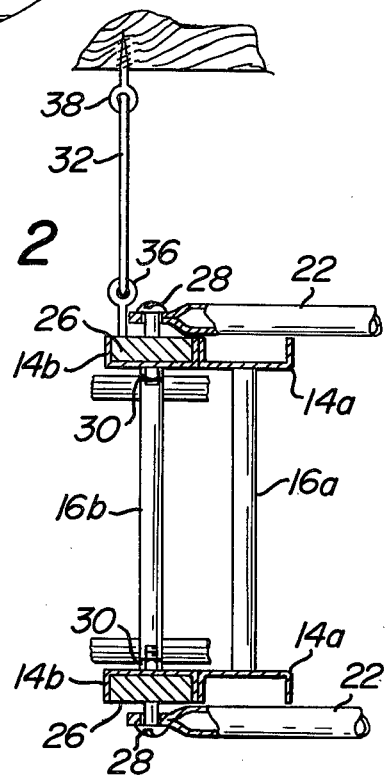
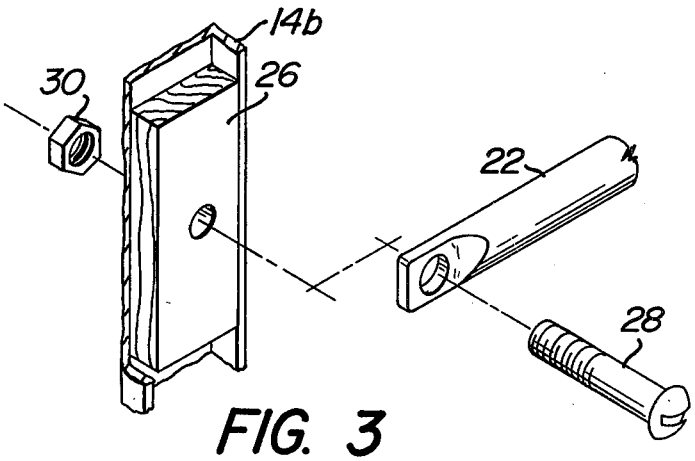
FIG. 3

LADDER SCAFFOLD

The present invention relates to a ladder scaffold and particularly to a ladder which can be easily assembled and moved about even by a single person.

When doing work in or around a building, such as a house, it is often desirable to use a scaffold. However, most scaffolds are relatively complex structures which are relatively expensive for home use and are difficult to assemble and move around. In addition, it is often difficult to make the scaffold stand steady, particularly when the ground adjacent the building is uneven.

Therefore, it is an object of the present invention to provide a novel ladder scaffold.

It is another object of the present invention to provide a scaffold which is relatively simple in construction so as to be inexpensive and easily assembled and disassembled.

It is still another object of the present invention to provide a scaffold which can be easily moved, but which will be steady at any particular location.

It is yet another object of the present invention to provide a scaffold which can be braced with respect to the building adjacent to which the scaffold is used.

Other objects will appear hereinafter.

These objects are achieved by a scaffold which includes a pair of upright ladders, each of which is extendable for varying its height, and at least one pair of diagonally crossing brace rods secured at their end to the side rails of the ladders to support the ladders in the upright position. A hook may be hingedly secured to the side rail of one of the ladders with the hook being engagable with an eye secured to a building to brace the scaffold with respect to the building. Also, wheels may be provided at the bottom of one of the ladders to permit ease of moving the scaffold.

The invention accordingly comprises the features of construction, combination of elements, and arrangement of parts, which will be exemplified in the construction hereinafter set forth, and the scope of the invention will be indicated in the claims.

For a fuller understanding of the nature and objects of the invention, reference should be had to the following detailed description taken in connection with the accompanying drawing in which:

FIG. 1 is a perspective view of the ladder scaffold of the present invention;

FIG. 2 is a sectional view taken along line 2—2 of FIG. 1; and

FIG. 3 is an exploded perspective view showing the manner of attaching a cross brace to a ladder.

Referring to FIG. 1, the ladder scaffold of the present invention is generally designated as 10. Ladder scaffold 10 includes a pair of extension ladders 12 each formed of upper and lower sections **12*a* and 12*b*. Each of the sections 12*a* and 12*b* is made up of a pair of spaced, parallel side rails 14*a* and 14*b* and a plurality of spaced, parallel rungs 16*a* and 16*b* extending between and secured to the side rails 14*a* and 14*b* respectively. The side rails 14*a* and 14*b* are U-shaped and are arranged with their open sides facing away from each other. Each of the upper sections 12*a* is supported on a lower section 12*b* by rings 18 which extend around the side rails 14*a* and 14*b* and by hooks 20 pivotally mounted on the side rails 14*a* of the upper sections 12*a* and engagable with the rungs 16*b* of the lower sections 12*b* so as to fix the longitudinal adjustment of the length of the ladders 12**.

The ladders 12 are held in upright, spaced substantially parallel relation by brace rods 22. The brace rods 22 are arranged in pairs of two rods which extend diagonally between the side rails **14*b* of the lower sections 12*b* of the two ladders 12, and cross each other. The crossing brace rods 22 are secured together at their point of crossing by bolts 24. The ends of the brace rods 22 engage spacer blocks 26 which fit in the U-shaped side rails 14*b*, and are secured to the side rails 14*b* by bolts 28 and nuts 30. The bolts 28 extend through holes in the ends of the brace rails 22, the spacer blocks 26 and the side rails 14*b*. As shown, there are two sets of crossed brace rods 22 on one side of the scaffold 10 and a single set on the other side. On the side of the scaffold 10** having the two sets of the crossing brace rods the bottom ends of the upper set are secured to the same spacer block as the upper ends of the lower set. The number of sets of crossing brace rods can vary depending on the height of the scaffold.

A rod 32 having a hook 34 at one end is secured to a side rail **14*b* by an eye bolt 36 pivotally secured to the other end of the rod 32. The hook 34 is adapted to fit into an eye screw 38 which is secured to the building. This provides additional bracing of the scaffold 10 with respect to the building. The length of the rod 32 will determine the distance that the scaffold can be spaced from the building. Although the scaffold 10 is shown with a single hook rod 32 on one of the ladders 12, there can be hook rods 32 on both ladders 12 and more than one on each ladder. The more hook rods 32** used, the greater the stability of the scaffold with respect to the building.

At the bottom of one of the ladders 12 are mounted a pair of wheels 40. This permits ease of moving the scaffold 10 by merely lifting the ladder which has no wheels and then rolling the scaffold along on the wheels. When the ladder which has no wheels is placed back on the ground, it will prevent further movement of the scaffold. Platform planks 42 can be rested on the rungs **16*a*, 16*b* of the ladder 12 to permit a person to stand thereon. The planks 42** can be shifted up or down to various rungs to change the height that the person can be at.

Thus, it can be seen that the scaffold 10 of the present invention is made of a minimum number of parts, basically the two ladders 12, the brace rods 22 and the platform planks 42, so as to be relatively inexpensive. Also, since the scaffold 10 is made up of so few parts, it can be easily assembled and disassembled. The height of the scaffold can be easily adjusted, even by a single person, by merely adjusting the height of the extension ladders 12 and moving the platform planks 42. The scaffold 10 can be easily moved by merely lifting up the ladder 12 which does not have the wheels and rolling the scaffold along on the wheels. However, when the ladder is set down again, it will prevent further rolling of the scaffold. In addition, the hook rods 32 permit the scaffold to be well braced with respect to the wall along which the scaffold is mounted even if the ground is uneven.

It will, thus, be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

What is claimed is:

1. A movable scaffold comprising a pair of upright ladders, each of said ladders having a pair of upright U-shaped side rails and a plurality of spaced rungs secured between said side rails and upper blocks received within and at the ends and center thereof, each of said ladders being adjustable in height by having two vertically slidable upper and lower sections, two pairs of diagonally crossing brace rods extending between said ladders, the ends of each of said brace rods being secured to respective spacer blocks of a pair of opposite respective lower side rails of said ladders positioning said ladders with respect to each other with their side rails and rungs respectively spaced opposite and parallel to each other each block at the ends of said lower side rails being secured with one while the center blocks each being secured with two ends of said brace rods of said brace rods, and a pair of wheels rotatably mounted at the bottom end of the lower section of only one of the ladders.

2. A scaffold in accordance with claim 1 including at least one rod having a hook at one end and being privotally secured at its other end to and end block at said upper end of said lower side rail one of the ladders, said hook being adapted to fit into an eye secured to a wall to brace the scaffold with respect to the wall.

3. A scaffold in accordance with claim 2 in which each end of each of the brace rods is secured to its respective side rail by a bolt extending through the end of the brace rod, a spacer block and the base of the side rail and a nut on the end of the bolt.

4. A scaffold in accordance with claim 1 in which each of the two vertically extending sections of the ladders are in at least partially overlapping relation and adjustably connected together to permit the adjustment of the overall length of the ladders.

5. A scaffold in accordance with claim 4 in which the two sections of each ladder are adjustably secured together by bands extending around the side rails of the two sections, and at least one hook pivotally mounted on the side rail of the upper section and engagable with the rungs of the lower section.

* * * * *